United States Patent [19]

Mawer

[11] 4,385,755

[45] May 31, 1983

[54] CLAMPING DEVICE

[75] Inventor: Gary I. Mawer, Paradise, Calif.

[73] Assignee: Face Maker Industry, Paradise, Calif.

[21] Appl. No.: 254,604

[22] Filed: Apr. 16, 1981

[51] Int. Cl.[3] ..... B25B 1/20

[52] U.S. Cl. ..... 269/41; 269/87.3; 269/155; 269/242; 269/252

[58] Field of Search ..... 269/87, 87.1, 87.2, 269/87.3, 41–42, 152–155, 288, 242, 252; 227/26, 152; 29/772, 238, 281.1, 281.5; 144/353, 3 L, 3 M; 145/30 R, 46; 408/115 R, 115 B, 105–106, 108, 109

[56] References Cited

U.S. PATENT DOCUMENTS

| | | | |
|---|---|---|---|
| 1,730,510 | 10/1929 | Jensen | 269/42 |
| 2,322,380 | 6/1943 | Mosley | 269/152 |
| 2,600,583 | 8/1952 | O'Connor . | |
| 2,602,238 | 7/1952 | Wellman | 408/105 |
| 3,086,408 | 4/1963 | Donals | 408/115 |
| 3,189,341 | 6/1965 | Maurus | 269/153 |
| 3,552,239 | 1/1971 | Yeaman et al. | 408/108 |
| 3,682,467 | 8/1972 | Heinrich | 269/41 |
| 3,694,100 | 9/1972 | Blair . | |
| 3,914,871 | 10/1975 | Wolff | 408/115 R |
| 4,126,259 | 11/1978 | Galer et al. | 227/152 |
| 4,158,523 | 6/1979 | Schotzko | 408/115 R |
| 4,165,869 | 8/1979 | Williams . | |
| 4,256,295 | 3/1981 | Egner | 269/152 |

FOREIGN PATENT DOCUMENTS

| | | | |
|---|---|---|---|
| 1455773 | 11/1976 | United Kingdom | 269/41 |
| 1473650 | 5/1977 | United Kingdom | 269/41 |

*Primary Examiner*—Robert C. Watson

*Attorney, Agent, or Firm*—Fliesler, Dubb, Meyer & Lovejoy

[57] ABSTRACT

A clamping device has a first and a second clamp for holding several workpieces together in a predetermined configuration and guides for allowing fasteners to be accurately positioned for holding the workpieces together once the clamping device is removed from the workpieces. The clamping device includes a body and the first clamp includes first and second arms and a device which selectively and positionably mounting the arms relative to the body and the second clamp includes a member and a device for mounting the member relative to the body and for selectively positioning the member relative to the first and second arms. Further the guides means includes first and second guides secured to the first and second arms.

12 Claims, 5 Drawing Figures

22
54
64
28
58
62
42
24
48
32
46
36
44
40
39
30
14
34
41
68
16
12
18
20
26
13
70
56
66
63
60
38
50
52
81
84
80
82
78
76
74
88
92
94
72
86
90
96
98

CLAMPING DEVICE

TECHNICAL FIELD

The present invention relates to a clamping means, and more particularly, to a clamping device for holding two or more workpieces in position for fastening same together.

BACKGROUND ART

For purposes of making cabinets and other precision fabrications from wood and other materials there is a requirement the workpieces be held in a spatial relationship with each other so that they can be fastened together. For example, the face frame of a cabinet, to which the cabinet door is secured by a hinge, is comprised of, in general, several workpieces of rectangular stock. Generally, these workpieces are fastened together at right angles in such a way as to define the various cabinet openings over which the cabinet doors are placed.

There are some commercially available clamping arrangements which can be used to hold one workpiece in a fixed position relative to another workpiece so that the workpieces can be fastened together. These devices generally have several clamping means. each clamping means for securely holding one of the workpieces in a predetermined orientation with respect to the other workpiece so that they may be fastened together with appropriate fastening means.

There also presently exists a face framing table where the various members of the face of a cabinet can be laid out and held in place by, for example, air-actuated clamps. Normally, screws and/or staples are used to secure the individual members of the frame together. When screws are used, one of the two members to be joined is removed to a table which has a drill jig and drill so that appropriate bores can be made in the member. The member is then repositioned on the framing table and screws are placed through the bores to fasten the members together. These steps are repeated until the entire face of the cabinet is assembled.

It is to be understood that none of the above prior art devices affords an arrangement where not only can the members be clamped in the final arrangement, but also the appropriate bores made and fasteners attached to make a final connection without having to, as in the case of the face framing table, remove the members to a second location to provide the necessary bores. Further, it is to be understood that some of the prior art clamping arrangements, while allowing two members to be joined in a perpendicular relationship such as, for example, that of a "T," do not have the versatility of allowing members to be joined together in, for example, a "cross" orientation. In addition, the face framing table is quite expensive to purchase and requires a large scale cabinet operation to be justified economically.

DISCLOSURE OF THE INVENTION

The present invention is directed to overcoming one or more of the problems as set forth above.

In one aspect of this invention the clamping device includes a first clamp means adapted for clamping onto a workpiece, a second clamp means adapted for clamping onto another workpiece and for positioning the another workpiece adjacent the first workpiece, and guide means adapted for guiding fasteners into the workpieces to hold the workpieces together.

The clamping device allows the workpieces to be held together in a substantially perpendicular arrangement such that the members can form either a "T" or a "cross" configuration. The guides enable, if desired, bores to be accurately drilled in the workpieces to receive the fasteners and then guide the application of the fasteners into the workpieces. The guides are oriented so that the fasteners are directed slopingly into the workpieces and toward each other to allow for the secure fastening of the workpieces together. Further, the invention is relatively inexpensive to produce in comparison to the prior art face framing table.

DETAILED DESCRIPTION OF THE PREFERRED EMBODIMENT

Figure 1:
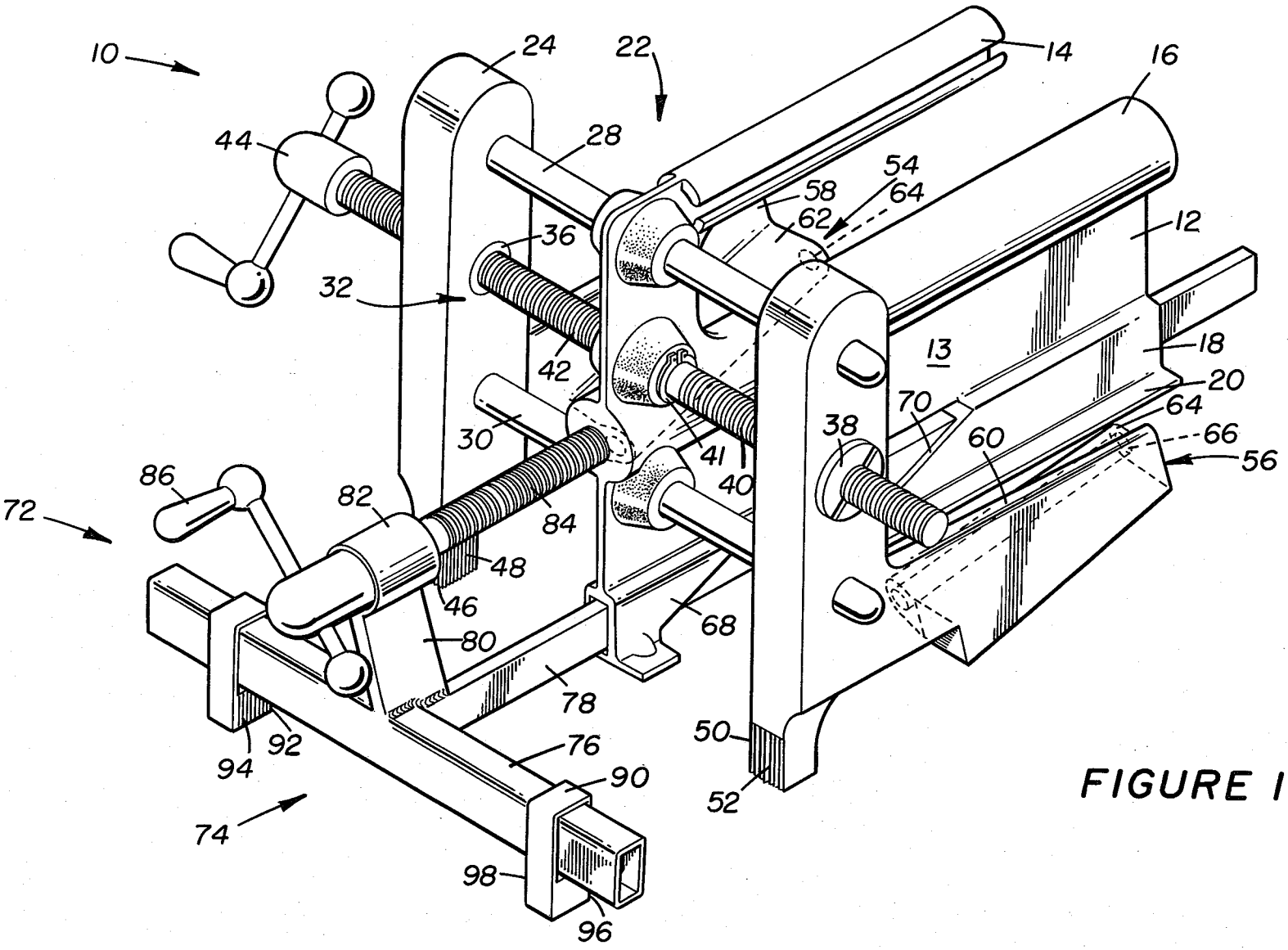
FIG. 1 depicts a perspective view of an embodiment of the clamping device of the invention.
Figure 2:
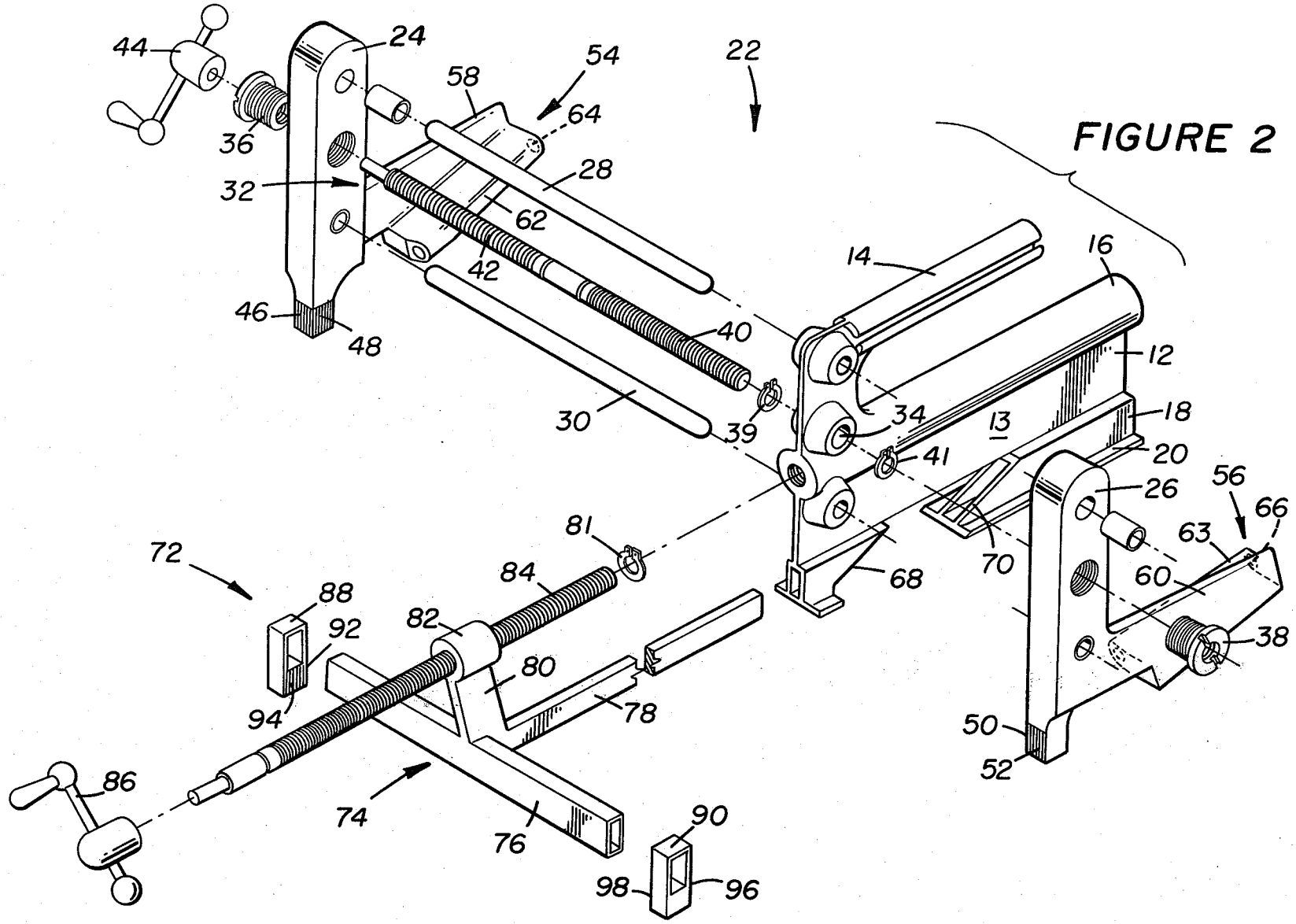
FIG. 2 depicts an exploded perspective view of the embodiment of FIG. 1.

With reference to the figures, the clamping device of the invention is depicted and generally denoted by the numeral 10. Clamping device 10 includes a clamp body 12 which has main body portion 13, a handle 14, a threaded guide 16, and a guide channel 18, which thread guide 16 and guide channel 18 will be described more fully hereinbelow. Also, clamp body 12 includes a flange 20 located immediately below guide channel 18 and substantially perpendicular to the main body portion 13 of the clamp body 12. The thread guide 16 is substantially intermediate the handle 14 and the guide channel 18, and said handle 14, guide 16 and channel 18 are substantially in the same plane as the main body portion 13 of the clamp body 12. In a preferred embodiment, the clamp body can be comprised of an aluminum casting. However, other fabrication techniques can be used to form body 12.

Clamping jig 10 includes a first clamp means which is generally denoted 22. First clamp means 22 includes a first arm 24 and a second arm 26. Arms 24 and 26 are slidably mounted on dowels 28 and 30, which are fastened to and extended perpendicularly to main body portion 13 of clamp 12. Interposed between the first and second dowels 28 and 30 is a threaded shaft 32 which is allowed to rotate freely through an unthreaded bore 34 in main body portion 13 and to rotate in threaded bores 36 and 38 of first and second arms 24 and 26, respectively. Threaded shaft 32 includes a right-hand threaded portion 40 and a left-hand threaded portion 42. Snap rings 39 and 41 hold shaft 32 relative to body 12 such that shaft 32 can rotate in bore 34, but is not able to move laterally with respect to body 12. A crank 44 is affixed to the end of the threaded shaft 32 adjacent first arm 24. First clamp means 22 is self-centering in that a clockwise rotation of crank 44 causes first and second arms 24 and 26 to move inwardly at the same rate about a workpiece, centering the workpiece with respect to body 12, and a counterclockwise rotation of crank 44 causes first and second arms 24 and 26 to move outwardly from main body portion 13 at the same rate. Below the second dowel 30, first and second arms 24 and 26 define substantially perpendicular bearing surfaces 46 and 48, and 50 and 52, respectively. These bearing surfaces can include an elastomeric material mounted on the ends of the arms 22 and 24 to protect the workpiece. It is to be understood, however, that if desired such material can be left off of the clamping device 10.

Extending rearwardly from the first and second arms are drill and screw guides 54 and 56, respectively. In a preferred embodiment, the arm 24 and drill and screw guide 54, and arm 26 and guide 56 are cast as one piece, preferably out of aluminum. However, it is to be understood that these arms and guides can be individually fabricated are machined and then secured together with appropriate fastening means.

The guides 54 and 56 essentially comprise flange portions 58 and 60 which extend rearwardly from the arms 24 and 26, and block portions 62 and 63. The block portions 62 and 63 are sloped downwardly, as can be seen in FIG. 1. Each block includes a guide bore 64 and 66, which guide bores are directed upwardly toward the main body portion 13 and toward each other. Thus, the drill and screw guides 54 and 56 allow, as will be more fully described hereinbelow, fasteners to be inserted through the workpieces in a downwardly sloping and inwardly directed manner.

Returning to the main body portion 13, and in particular to the guide channel 18 and the flange 20 as discussed hereinabove, a substantially acute parallelgrammed portion has been removed from the channel 18 and the flange 20 to leave sloping surfaces 68 and 70. The removed portion allows the block portions 60 and 62 of the guides 50 and 54 to move close enough together with the turning of crank 44 to accommodate workpieces which are an inch and a half wide.

A second clamp means 72 includes a T-bar member 74, which is comprised of a load bearing member or bar 76 and a guide member or bar 78. Guide member 78 is slidingly received in guide channel 18 of the clamp body 12. Load bearing member 76 is substantially perpendicular to guide member 78, and thus is substantially perpendicular to the clamp body 12. Extending upwardly from T-bar member 74 is a pedestal 80. A bushing 82 is defined at the top of pedestal 80. An unthreaded portion of a threaded shaft 84 is received through bushing 82 and held there with a snap ring 81, and the threaded portion of threaded shaft 84 is received in threaded guide 16 of clamp body 12. A crank 86 is secured to the end of shaft 84 adjacent bushing 82. The clockwise rotation of crank 86 causes the load bearing member 76 of the T-bar member 74 to move inwardly toward the first and second arms 24 and 26 of the first clamp means 22.

Slidingly disposed on the load bearing member 76 are first and second slidable bearing blocks 88 and 90. Bearing block 88 has bearing surfaces 92 and 94 and bearing block 90 has bearing surfaces 96 and 98. In a preferred embodiment these surfaces can comprise an elastomeric material which covers the bearing blocks 88 and 90, respectively. However, it is to be understood that the rubberized material is used only for the protection of the workpiece and, if such protection is not required, can be eliminated. The bearing blocks 88 and 90 can be slid on the load bearing member 76 to appropriate locations so that they can accommodate, if required, any workpiece which is clamped by the first clamp means 22 and extends outwardly past the load bearing member 76 between the blocks 88 and 90.

As an alternative to the above embodiment, it is to be understood that the crank and threaded shaft of each of the clamp means 22 and 72 can be replaced by appropriately driven pneumatic means or cylinders and the like to allow for even more rapid positioning of the workpieces relative to each other and operation of the invention.

Also, it is to be understood that workpieces can be secured together in other than a perpendicular configuration with appropriate wedge blocks or other means (not shown) placed between the clamps and the workpieces.

Figure 3:
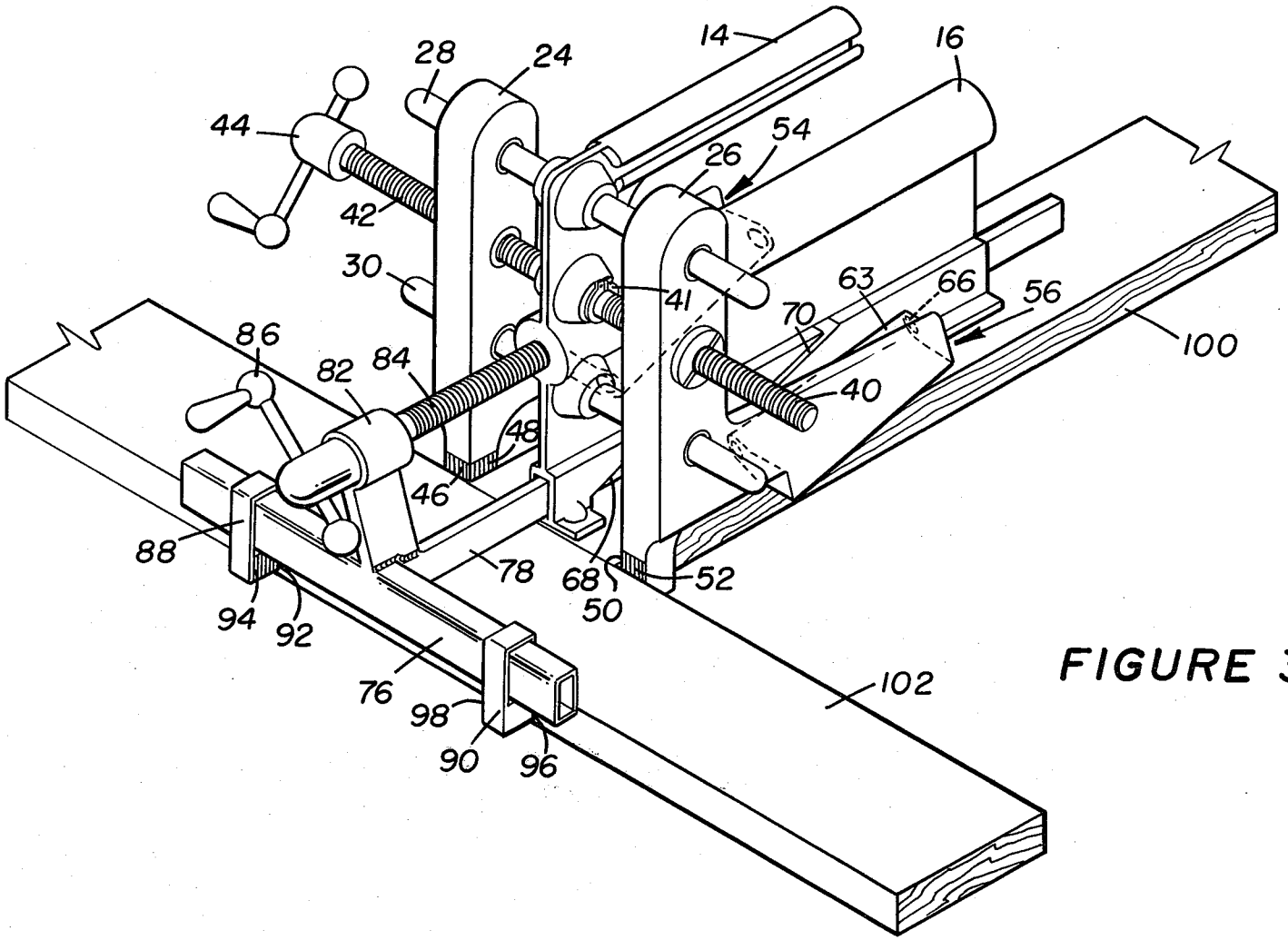
FIG. 3 depicts a perspective view of the invention of FIG. 1 holding one workpiece relative to a second workpiece.
Figure 4:
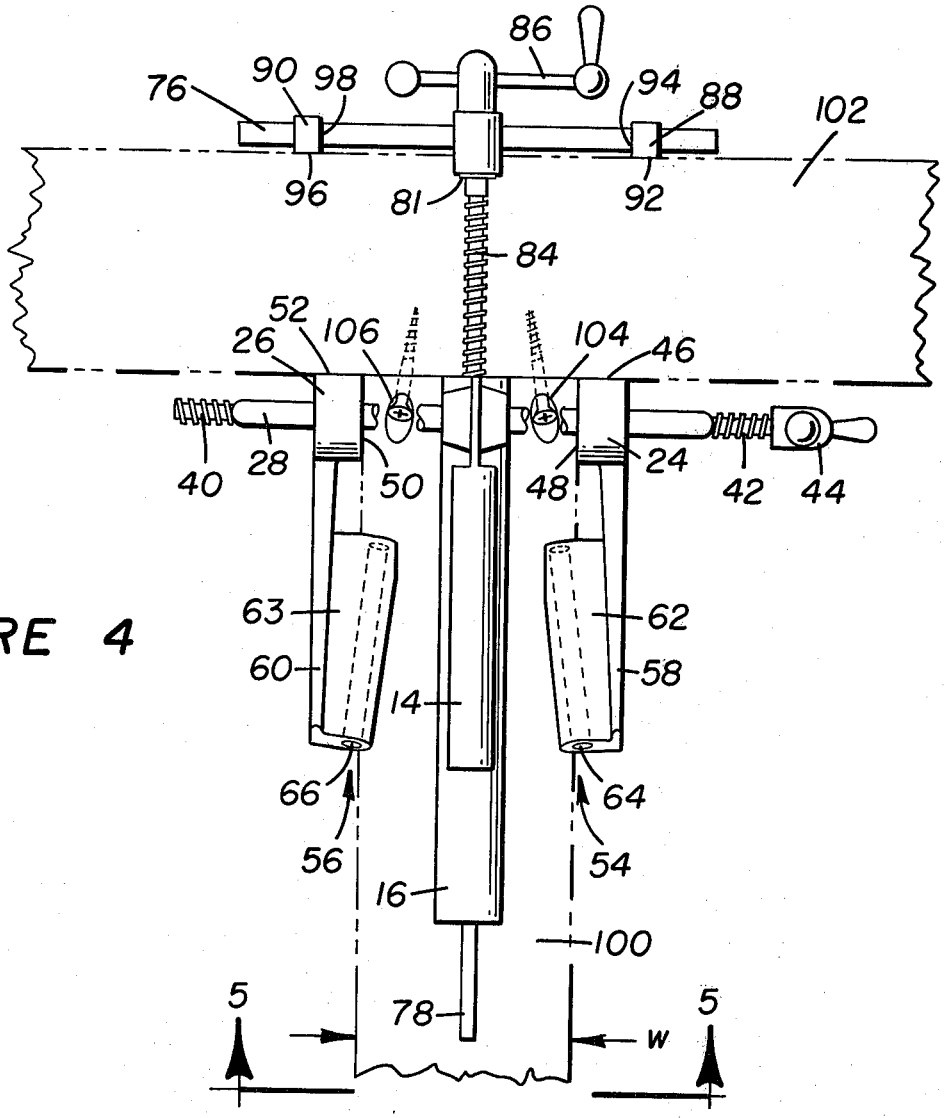
FIG. 4 depicts a plan view of the invention of FIG. 1 holding one workpiece relative to a second workpiece.
Figure 5:
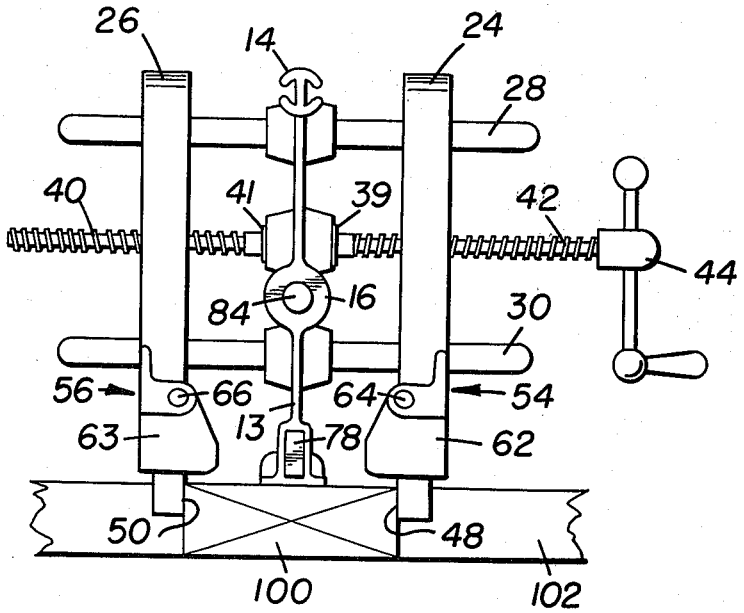
FIG. 5 depicts an end view of the embodiment of the invention of FIG. 1.

The operation of clamping device 10 is as follows. For assembling first and second workpieces 100 and 102 in a "T" configuration as shown in FIGS. 3 and 4, the first workpiece 100 is located on a flat surface and the clamping device 10 is positioned over said workpiece 100 so that the arms 24 and 26 of the first clamping means 22 are spaced apart from and are located on either side of the workpiece 100, with the flange 20 resting on top of the workpiece 100. As the first clamp means 22 is self-centering, the turning of the crank 44 allows the bearing surfaces 48 and 50 to approach the sides of the workpiece 100 and finally come in contact therewith to lockingly position the workpiece 100 with the block portions 60 and 62 of the drill and screw guides 54 and 56 positioned above the workpiece 100. Next, the second workpiece 102 is disposed between the arms 24, 26 and the bearing blocks 88 and 90 of the second clamp means 72. Second workpiece 102 is appropriately postioned relative to workpiece 100, glue is applied as required, and crank 86 is turned clockwise to tighten the second clamp means 72 about the workpiece 102 and hold it relative to workpiece 100. As workpieces 100 and 102 are placed on a flat surface when joined together, they define a flat surface. Next, a drill with a long shank is inserted into one and then the other of the guide bores 64 and 66 to drill starter holes 104 and 106 (FIG. 4) into workpiece 100. The drill is withdrawn and a fastener such as a self-tapping screw is attached to the end of, for example, a screwdriver drill bit, and the fastener and the drill bit are placed through the respective guide bores 64 and 66 so that the fastener can connect workpiece 100 to workpiece 102. It is noted that the fasteners are inserted in the workpieces in a downwardly-sloping and inwardly-projecting manner, with the heads of the fasteners recessed in the starter holes beneath the surface of the workpiece 100.

A common width of stock denoted by "W" in FIG. 4 is approximately an inch and a half. To accommodate such stock, the guides approach the clamp body 12 and are received between sloping surfaces 68 and 70 so that appropriately spaced starter holes can be drilled through workpiece 100 and into workpiece 102.

It is to be understood that workpieces 100 and 102 can be joined in other configurations, such as an "L" configuration. Further, a cross-configuration can be formed by using a third workpiece (not shown) and affixing it to the other side of 102 (once workpiece 100 is joined to workpiece 102) by applying the clamp device 10 to hold the third workpiece between the clamp means 22 while holding the workpiece 102 by the clamp means 72. Certainly, other configurations are possible.

Thus, it can be seen that the present invention solves the problems of the prior art by providing an inexpensive and highly effective clamping device for positioning one workpiece relative to another and guiding fasteners for properly securing the workpieces together. Unlike the prior art, the present invention allows for all the appropriate fastening steps to occur at one work site without having to move to a second work site to drill the appropriate holes and then returning to the first work site to assemble the workpieces together.

Other aspects, objects and advantages of this invention can be obtained from a study of the drawings, the disclosure and the appended claims.

I claim:

1. An apparatus comprising:

first clamp means adapted for clamping onto a first workpiece;

second clamp means adapted for clamping onto another workpiece and for positioning the another workpiece adjacent the first workpiece;

guide means adapted for guiding a fastener into the workpieces to hold the workpieces together;

a body;

wherein said first clamp means includes first and second arms and means for selectively and positionably mounting said arms relative to said body;

wherein said second clamp means includes a member and means for mounting said member relative to said body and for selectively positioning said member relative to said first and second arms; and wherein said guide means includes first and second guides secured to the first and second arms respectively.

2. The apparatus of claim 1 wherein said means for mounting said first and second arms self-centers said arms about the first workpiece.

3. The apparatus of claim 2 wherein said means for mounting said first and second arms includes a crank and a shaft mounted to said body, which shaft has a left-handed thread associated with one of said arms and a right-handed thread associated with the other of said arms.

4. The apparatus of claim 1 wherein said body includes a guide channel, and said means for mounting said member of said second clamp means includes a guide bar which is slidingly received in said guide channel, said member being substantially perpendicular to said guide bar.

5. The apparatus of claim 4 including at least one bearing member having a bearing surface, which bearing member is slidably mounted on said member of said second clamp means.

6. The apparatus of claim 4 wherein said means for selectively positioning said bearing member relative to said first and second arms includes a crank and a threaded shaft which is mounted to said bearing member and to said body.

7. The apparatus of claim 1 wherein each of said arms includes a bearing surface and said bearing member includes a bearing surface and wherein the first workpiece is held between the bearing surface of said arms and the another workpiece is held between the bearing surface of said bearing member and at least one of the bearing surfaces of said arms.

8. The apparatus of claim 1 wherein said first and second guides include means adapted for directing a first fastener and a second fastener, respectively, wherein said first fastener is directed slopingly into the workpiece and toward the second fastener and the second fastener is directed slopingly into the workpiece and toward the first fastener.

9. The apparatus of claim 1 wherein said body defines at least one recess for receiving the guide means.

10. The apparatus of claim 4 wherein a portion of said guide channel is cut away to receive said guide means.

11. The apparatus of claim 1 wherein said body defines a main body portion and a flange which is substantially perpendicular thereto, said flange being adaped to be mounted on top of a workpiece.

12. The apparatus of claim 11 wherein a portion of the flange is cut away to receive the guide means.

* * * * *